United States Patent [19]

Johnson

[11] Patent Number: 5,072,570

[45] Date of Patent: Dec. 17, 1991

[54] SEISMIC REINFORCEMENT STRUCTURE

[76] Inventor: Michael I. Johnson, 129 Paseo de las Delicias, Redondo Beach, Calif. 90277

[21] Appl. No.: 535,174

[22] Filed: Jun. 8, 1990

[51] Int. Cl.[5] ..... E04B 1/36; E04B 1/98

[52] U.S. Cl. ..... 52/747; 52/167; 52/693; 52/393; 248/638

[58] Field of Search ..... 52/167, 514, 741, 747, 52/742, 745, 294, 299, 693; 248/638

[56] References Cited

U.S. PATENT DOCUMENTS

| | | | |
|---|---|---|---|
| 2,089,023 | 4/1935 | Hahn | 52/694 |
| 3,691,712 | 9/1972 | Bowling et al. | 52/393 |
| 3,793,790 | 2/1974 | Love et al. | 52/693 |
| 4,001,999 | 1/1977 | Chandler | 52/693 |
| 4,031,686 | 6/1977 | Sanford | 52/693 |
| 4,065,218 | 12/1977 | Biggane | 52/167 X |
| 4,441,289 | 4/1984 | Ikuo et al. | 52/167 |
| 4,615,157 | 10/1986 | Murray | 52/167 |

*Primary Examiner*—Richard E. Chilcot, Jr.

*Assistant Examiner*—Kien T. Nguyen

*Attorney, Agent, or Firm*—Irving Keschner

[57] ABSTRACT

A method for providing earthquake reinforcement for existing wood frame buildings by providing two truss members, the first for securing the building to the foundation and the second to prevent the building cripple walls from collapsing during an earthquake.

The first truss member comprises a lower brace member supported between two L-shaped beams, a bolt through the brace member and through one L-shaped beam joining the first truss member to the concrete foundation, the second truss member comprising a brace member having a height determined by the height of the cripple wall and supported between upper and lower L-shaped beams, the lower L-shaped beam being bolted to the adjacent L-shaped beam of the first truss member.

The lower beam member of the second truss member is secured to a wood beam which in turn is fixed to the cripple wall. The upper beam member of the second truss member is secured to a wood beam fixed to the cripple wall.

6 Claims, 2 Drawing Sheets

SEISMIC REINFORCEMENT STRUCTURE

BACKGROUND OF THE INVENTION

1. Field of the Invention

The present invention provides an earthquake-resistant structure for existing wood frame buildings, and, in particular, to truss members which prevent both the building cripple walls from collapsing during an earthquake and for securing the building to its foundation.

2. Description of the Prior Art

In order to keep various independent elements within a structure intact during an earthquake, adequate supports and seismic bracing (anti-movement brace used to prevent adverse sway or movement in the event of an earthquake) must be installed. Without such seismic bracing, the independent movement can result in such elements breaking away from their installed position causing severe damage to the structure.

Many states, including California, passed laws mandating that all new buildings, residential or commercial, be constructed with certain seismic bracing features incorporated therein. However, owners of existing structures were not required to upgrade the structures to incorporate seismic bracing. In view of the fact that earthquake damage caused to structures which were reinforced was less severe than non-reinforced structures, legislation has been recently proposed that mandates that existing structures must be brought up to existing code requirements.

Existing code requires houses to be bolted to their foundation. However, when bolting down an older home, there is only about 2 ½ inches to about 3 inches of concrete on each side of the bolt. In many cases, the footings are slightly decomposed, making them vulnerable to seismic damage due to cracking and/or splitting of the foundation at the bolt location. In those homes built with cripple walls, bracing was typically accomplished by using strips of plywood. However, the plywood strips tend to rot due to moisture and termites, making the bracing ineffective.

Typical of the prior art seismic brace system installations are those disclosed in U.S. Pat. No. 4,065,218 to Biggane which discloses a channel iron having an articulated connection at each end, one end being connected to a building element, the other end being connected to the item supported; U.S. Pat. No. 4,441,289 to Ikuo et al. which discloses a method for providing earthquake reinforcement for existing buildings which uses a compression brace on the beam pillar structure of a building in a diagonal direction to the structure so as to apply a pre-compressive stress to the compression brace; U.S. Pat. No. 2,089,023 to Hahn which discloses a structural member designed to resist longitudinal stresses in a wall structure to prevent distortion and deformation of the wall, the member being arranged for attachment to a sill or foundation by suitable anchors when used as a foot piece or for attachment to rafters or joists when used as a header; and U.S. Pat. No. 4,615,157 to Murray which discloses a system for damping oscillations in building floor joists.

Although the various structures noted hereinabove provide techniques for reinforcing buildings against seismic damage, they are relatively costly and not specifically adapted to reinforce existing wood frame buildings or structures built before foundation anchor bolts were required by municipal building codes.

What is therefore desired is to provide a method for reinforcing existing wood frame structures against seismic stresses and, in particular, to prevent both the structure cripple walls from collapsing during an earthquake and to secure the structure to its foundation.

SUMMARY OF THE PRESENT INVENTION

The present invention provides a structure for earthquake reinforcement for existing wood frame buildings. The structure comprises a first truss member having a brace member supported between two L-shaped beams, a bolt through the brace member and an L-shaped beam joining the first truss member to the concrete foundation, thus spreading the seismic forces along the entire length of the truss member. The structure further includes a second truss member which comprises a brace member supported between upper and lower L-shaped beams, the lower beam being bolted to the adjacent beam of the first truss member. The lower beam of the first truss member is secured to a wood beam which in turn is fixed to the cripple wall. The upper beam of the second truss member is also secured to a wood beam which is fixed to the cripple wall.

The present invention thus provides a simple and economical method for reinforcing existing wood frame structures against earthquakes such that the structure can comply with municipal building codes.

DESCRIPTION OF THE DRAWING

For a better understanding of the invention as well as other objects and further features thereof, reference is made to the following description which is to be read in conjunction with the accompanying drawing wherein.

The same reference numbers used in each figure identify the same element.

DESCRIPTION OF THE PREFERRED EMBODIMENT

Figure 1:
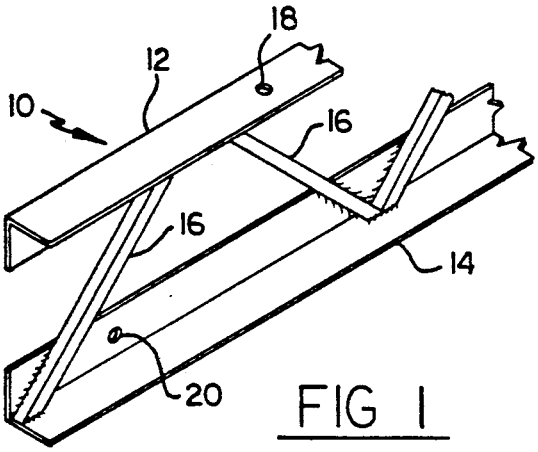
FIG. 1 is a perspective view of a truss member utilized in the present invention.
Figure 2:
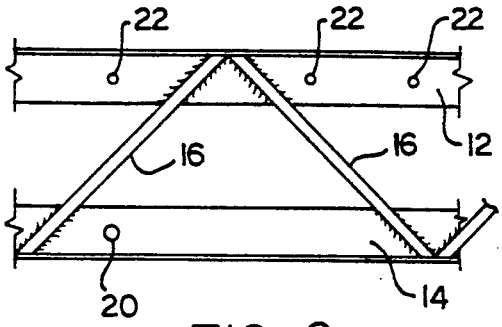
FIG. 2 is an elevational view of the system shown in FIG. 1.

Referring now to FIGS. 1 and 2, a truss member 10 utilized as the reinforcement structure in the present invention is illustrated. Member 10 comprises L-shaped beam, or section, members 12 and 14, typically 10 feet long, and square shaped brace members 16 welded to the beam members 12 and 14 at a 45° angle as shown. Preferably, the beam members 12 and 14 and brace members 16 are fabricated from steel. Openings 18 and 20 are formed in beams 12 and 14, respectively, as illustrated (although only single openings 18 and 20 are shown, additional openings are formed along the length of the beam members as will be described hereinafter). A plurality of openings 22 are also formed in one of the angled leg portions of beam 12 as illustrated.

Figure 3:
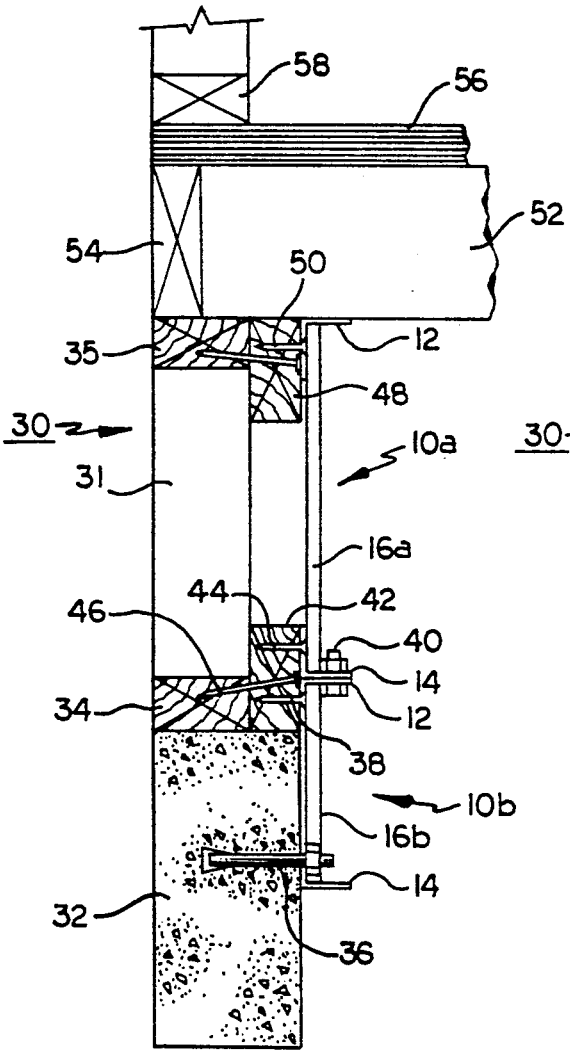
FIGS. 3 and 4 are side sectional views showing the installed brace system of the present invention in wood frame construction using cripple walls.

FIG. 3 illustrates how the truss member 10 is installed in one wood frame structure to reinforce the structure against seismic disturbances. In the embodiment illustrated, two separate truss members 10*a* and 10*b* are provided (actually, eight sets of truss members 10*a* and 10*b* are used; two sets at each foundation corner are typically utilized although additional truss members would be required if spacing between members exceeded six feet), truss member 10*a* to prevent cripple wall 30 (a cripple wall supports most house structures, such as floor joists; in the embodiments illustrated, cripple wall 30 comprises wood members 31 and 35) from collapsing during an earthquake and truss member 10*b* securing the structure to the concrete foundation 32. In essence, member 10*b* secures the mudsill 34 (mudsill is the term used for a piece of lumber that comes in contact with the concrete foundation; it is the base for which all other wood members are fixed) to the concrete foundation 32 to stop any vertical or horizontal movement. The height of brace member 16*a* in member 10*a* is determined by the size of cripple wall 30 and is typically 14 inches high; the brace member 16*b* in member 10*b*, typically 8 inches high, is bolted to foundation 32 using a plurality of concrete anchor bolts 36 (only one illustrated), having a strength capacity equal or exceeding building code requirements.

The top portion of member 10*b* is secured to mudsill 34 through openings 22 (FIG. 2) using bolts or screws 38 that meet building code requirements. The center-to-center spacing of screws 38 along the length of the beam member 12 is determined in accordance with the shear and hold-down values required by the building code.

The bottom of each truss member 10*a* is bolted to the top of truss member 10*b* with bolts 40 (only one shown), bolt 40 having the strength capacity as required by municipal building codes, the spacing between each bolt 40 also being determined by code requirements. The bottom of truss member 10*a* is secured to a newly installed wood beam 42 via nails 44 sixteen inches on center (screws or bolts can also be used) through openings formed in beam 14. Wood beam 42 is joined to the mudsill portion 34 of cripple wall 30 by nails 46, for example. All screws or bolts range in size to conform with code requirements. The top of the truss member 10*a* is then joined to added wood beam 48 by nails 50 (a bolt can also be used) sixteen inches on center of a size that meets code requirements. The spacing between each screw (or bolt) 50 is calculated in accordance with the shear and hold-down values required by code. Other components of the wood frame structure shown in FIG. 3 include joist member 52, blocking member 54, subfloor 56 and base plate 58. The lower section of truss member 10*b* has three bolts, one 12 inches in from each end and the third in the center of the section. The upper section of truss member 10*b* has screw holes at four inches on center. Truss member 10*a* has screw holes in both the bottom and top of each section at four inches on center. The hole used to join truss members 10*a* and 10*b* together are along the lower section of member 10*a* and the upper section of member 10*b* and are spaced at sixteen inches on center.

Figure 4:
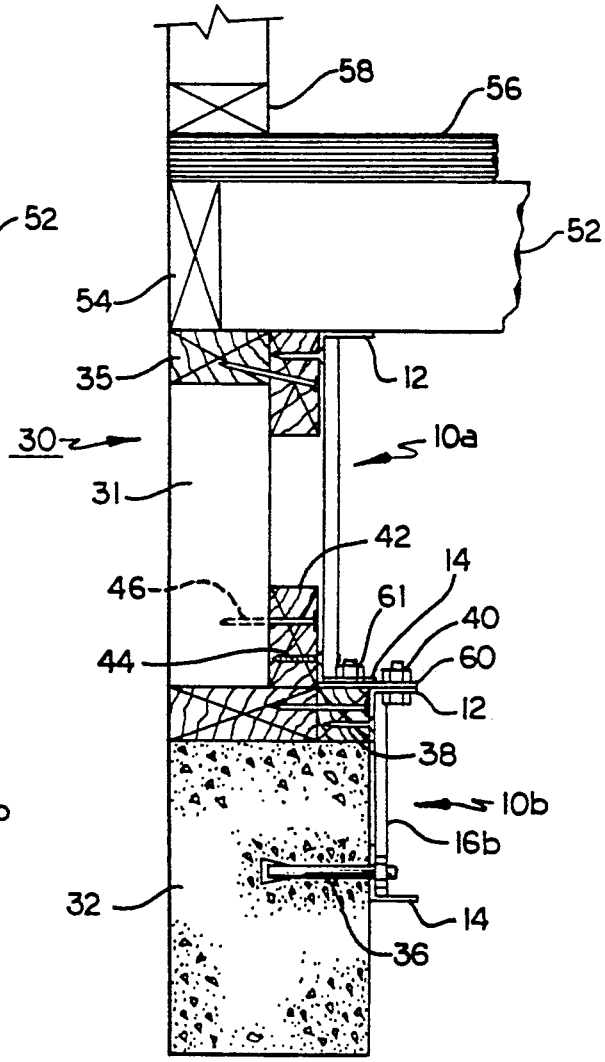
Figure 5:
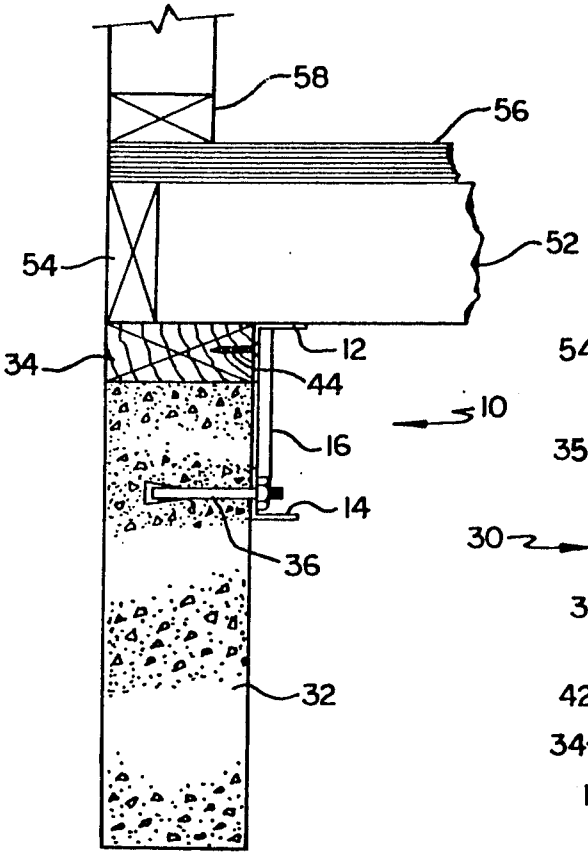
FIG. 5 is a side sectional view showing the installed brace system of the present invention in a wood frame construction without a cripple wall.

FIG. 4 illustrates how truss members 10*a* and 10*b* are installed in another wood frame structure. A splicing plate 60 strengthens the coupling of truss member 10*a* to cripple wall 30 and a separate bolt 61 secures section 14 of truss member 10*a* to plate 60. FIG. 5 shows a truss member 10*b* being used in a structure without cripple walls, the floor joists 52 laying directly on mudsill 34.

Figure 6:
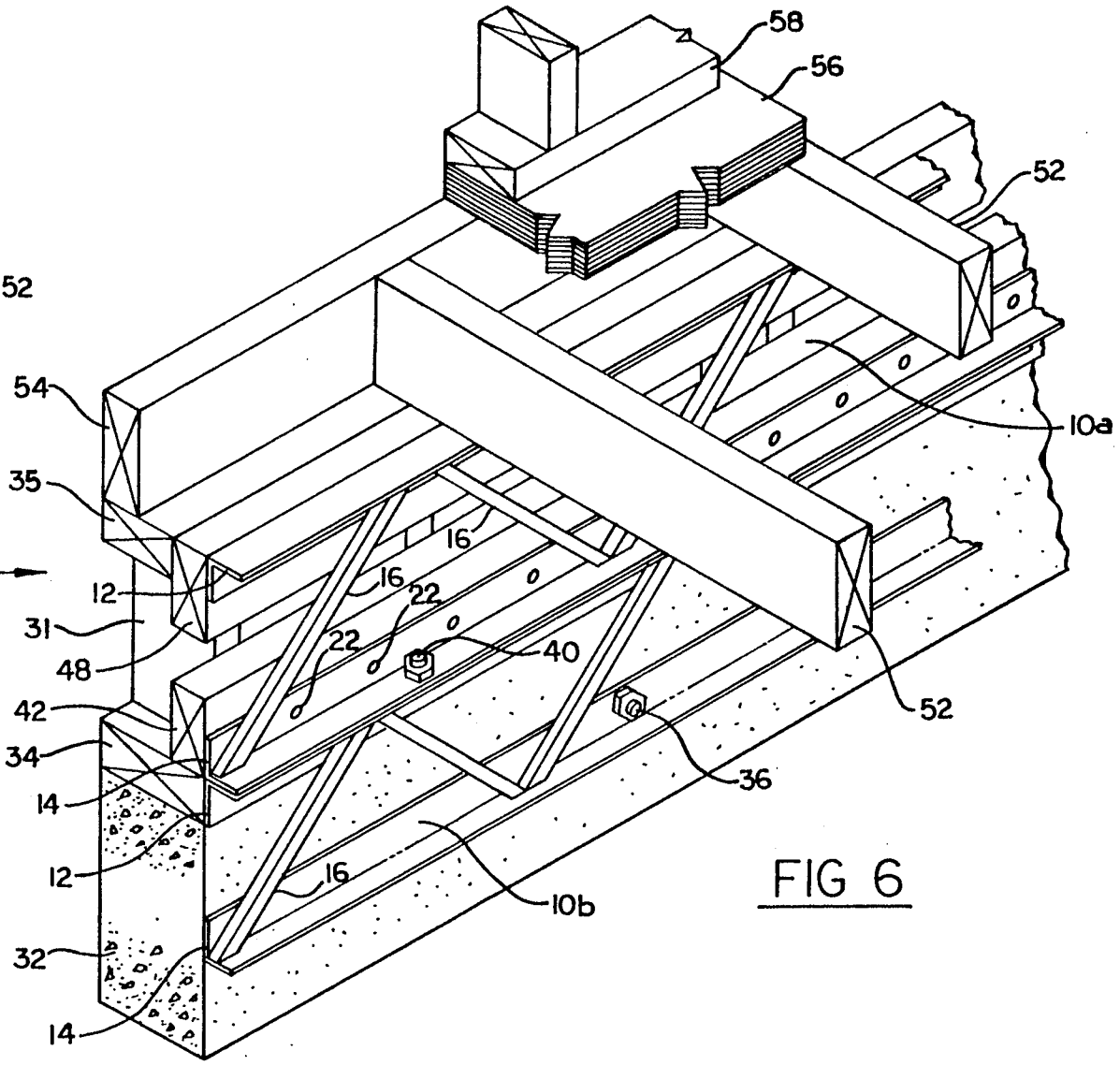
FIG. 6 is a perspective view illustrating the installed brace system of the present invention.

FIG. 6 is a perspective view illustrating the installation of the reinforcement structure of the present invention and shows in more detail the coupling of truss members 10*a* and 10*b* to the wood frame structure cripple wall and foundation.

The details of a specific truss member 10*b* (truss member 10*a* is similar with the exception that truss member 10*b* has three bolt holes in the lower angle section rather than screw holes at 4 inches on center) which have been successfully tested are as follows: The truss comprises two steel 10 foot long equal angles 12 and 14 with 2 inch equal legs which are ⅛ inch in thickness. The angles are spaced apart by 8 inches. The angles are laced together by ⅝ inch square tubing 16 which have 1/16 inch thick walls. The tubes 16 are installed at 45° to the horizontal, with the interior angle of each tube 16 90° to the following tube. The tubes are welded to the angles with a minimum of 4 inches of 1/16 inch fillet weld each end using E70 electrodes. The steel for the angles and tubes is to meet the minimum yield and tensile requirements for A36 carbon steel. The bottom angle is connected to the concrete foundation 32 with three Phillips Red Head Wedge type anchors 36 with 4 inch minimum embedment into sound concrete, 3 inch minimum edge distance "A", one anchor being used at each end of the beam 14 and in the approximate center thereof. The top angle is connected to the mudsill 34 or other wood member with No. 8 wood screws with a minimum penetration into the receiving wood member of 1 ¼ inch. The spacing of the screws could be either 4 or 8 inches on center, depending on the desired load capacity. Installation of the structure described hereinabove provides a relatively simple and inexpensive technique for reinforcing existing wood frame building structures against earthquakes and thus minimizing the damage caused thereby.

The present invention thus provides a single and inexpensive technique for preventing cripple walls in older wood frame homes from collapsing during an earthquake and for securing the structure to the foundation by using steel truss members to spread the force of the earthquake along the entire length.

While the invention has been described with reference to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. An earthquake-resistant reinforcement method for an existing wood frame structure having a concrete foundation, an original wood member supported by said foundation, and a cripple wall supported on said original wood member comprising the steps of:

(a) providing a first elongated truss member comprising spaced first and second L-shaped sections connected together by angled brace members;

(b) providing a first additional wood member;

(c) securing said first additional wood member to said cripple wall; and (d) securing said first L-shaped section of said truss member to said first additional wood member.

2. The method of claim 1 including the steps of providing a second additional wood member, securing said second additional wood member to said original wood member and securing said second L-shaped section of said first truss member to said second additional wood member.

3. The method of claim 2 further including the steps of:

(a) providing a second elongated truss member comprising spaced first and second L-shaped sections connected together by angled brace members;

(b) securing the first L-shaped section of said second truss member to said second additional wood member; and (c) securing the second L-shaped section of said second truss member to said concrete foundation.

4. The method of claim 3 further including the step of securing the second L-shaped section of said first truss member to the first L-shaped section of said second truss member.

5. The method of claim 3 further including the steps of securing the second L-shaped section of said first truss member to a plate member and securing the first L-shaped section of said second truss member to said plate member.

6. An earthquake-resistant reinforcement method for an existing wood frame structure having a concrete foundation and an original wood directly contacted with and member supported by said foundation comprising the steps of:

(a) providing an elongated truss member comprising spaced first and second L-shaped sections connected together by angled brace members;

(b) securing said first L-shaped section to said original wood member; and (c) securing said second L-shaped section to said concrete foundation.

* * * * *